US007999472B2

(12) United States Patent
Kwon

(10) Patent No.: US 7,999,472 B2
(45) Date of Patent: Aug. 16, 2011

(54) PLASMA DISPLAY PANEL

(75) Inventor: Osung Kwon, Busan (KR)

(73) Assignee: LG Electronics Inc., Seoul (KR)

( * ) Notice: Subject to any disclaimer, the term of this patent is extended or adjusted under 35 U.S.C. 154(b) by 250 days.

(21) Appl. No.: 12/092,445

(22) PCT Filed: Jun. 29, 2007

(86) PCT No.: PCT/KR2007/003180

§ 371 (c)(1),
(2), (4) Date: May 2, 2008

(87) PCT Pub. No.: WO2008/002099

PCT Pub. Date: Jan. 3, 2008

(65) Prior Publication Data

US 2008/0278075 A1 Nov. 13, 2008

(30) Foreign Application Priority Data

Jun. 30, 2006 (KR) ..... 10-2006-0060867

(51) Int. Cl.
*H01J 17/49* (2006.01)

(52) U.S. Cl. ..... 313/582; 313/585

(58) Field of Classification Search ..... 313/585
See application file for complete search history.

(56) References Cited

U.S. PATENT DOCUMENTS

| | | | | |
|---|---|---|---|---|
| 7,473,519 | B2 * | 1/2009 | Lin | 430/319 |
| 2002/0125486 | A1 * | 9/2002 | Kondo et al. | 257/79 |
| 2003/0235649 | A1 | 12/2003 | Ashida et al. | |
| 2005/0110405 | A1 | 5/2005 | Song | |
| 2005/0134177 | A1 * | 6/2005 | Asida et al. | 313/582 |
| 2006/0233946 | A1 * | 10/2006 | Lin | 427/64 |
| 2008/0079347 | A1 * | 4/2008 | Kang | 313/491 |

FOREIGN PATENT DOCUMENTS

| | | | |
|---|---|---|---|
| EP | 0160459 | A2 | 11/1985 |
| JP | 11-096925 | A | 4/1999 |
| JP | 11-111182 | A | 4/1999 |
| JP | 11-283511 | A | 10/1999 |
| KR | 1020050034317 | A | 4/2005 |

OTHER PUBLICATIONS

International Search Report and Written Opinion dated Oct. 8, 2007 for Application No. PCT/KR2007/003180; 11 pages.
European Search Report dated Jul. 21, 2010 for Application No. 07768551.9, 5 pages.

* cited by examiner

*Primary Examiner* — Anne M Hines
*Assistant Examiner* — Jacob Stern
(74) *Attorney, Agent, or Firm* — Fish & Richardson P.C.

(57) ABSTRACT

A plasma display panel is disclosed. The plasma display panel includes a substrate, a plurality of electrodes positioned on the substrate, a dielectric layer covering the plurality of electrodes. A height of the electrode around a central axis of a cross section of the electrode is larger than a height of the electrode at an edge of the cross section of the electrode.

10 Claims, 8 Drawing Sheets

[Fig. 1]
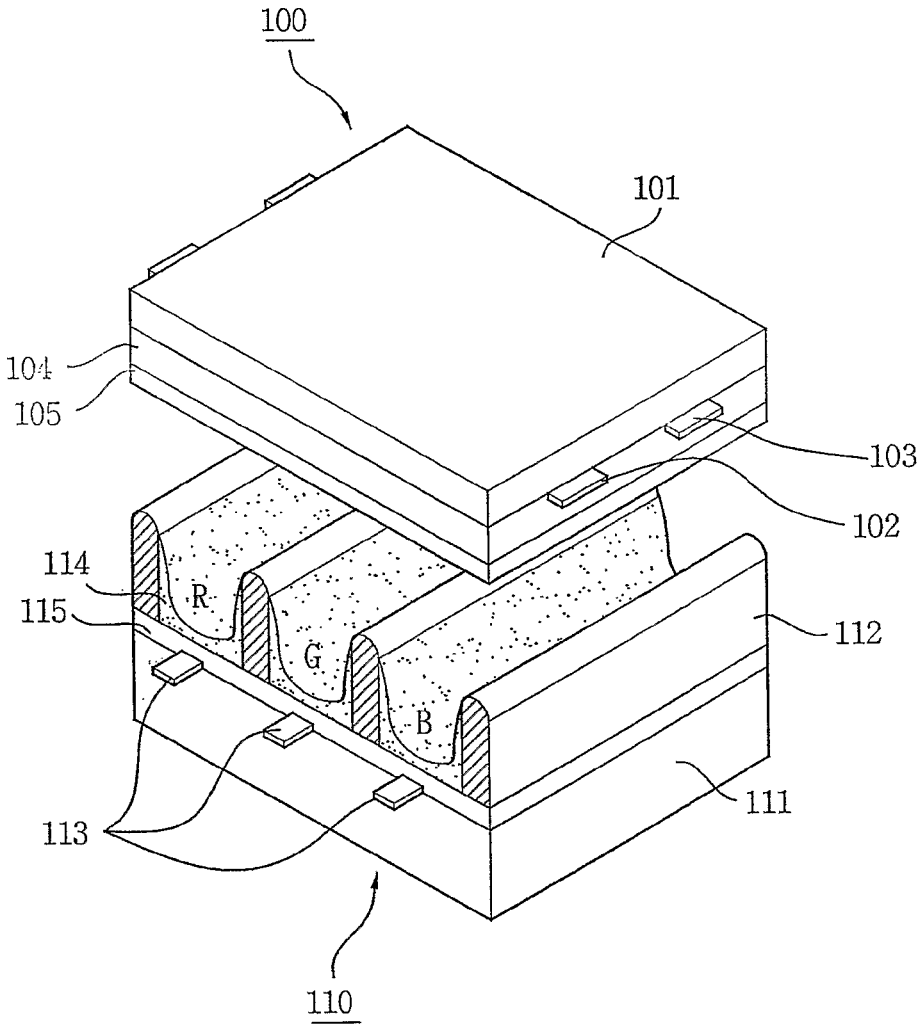
[Fig. 2]
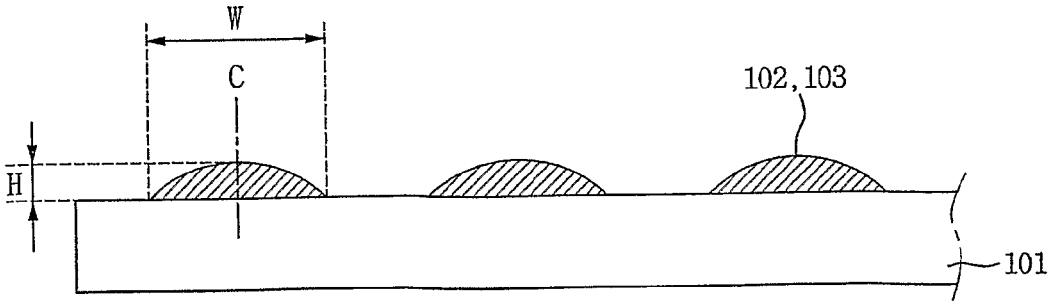

[Fig. 3]
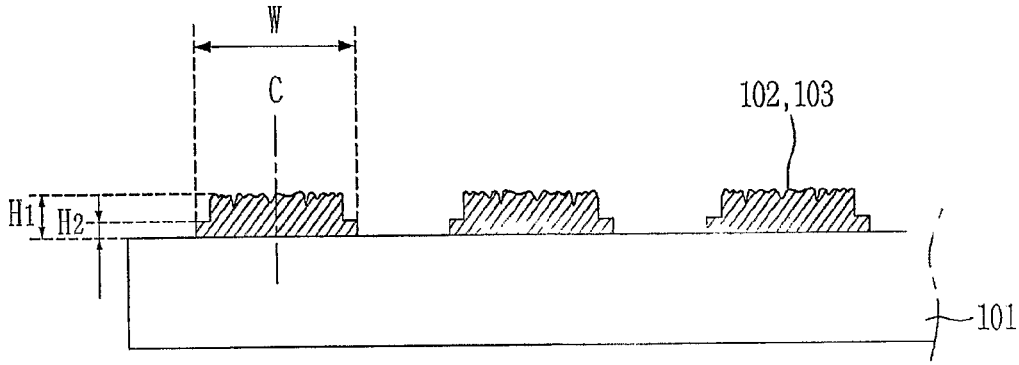
[Fig. 4]
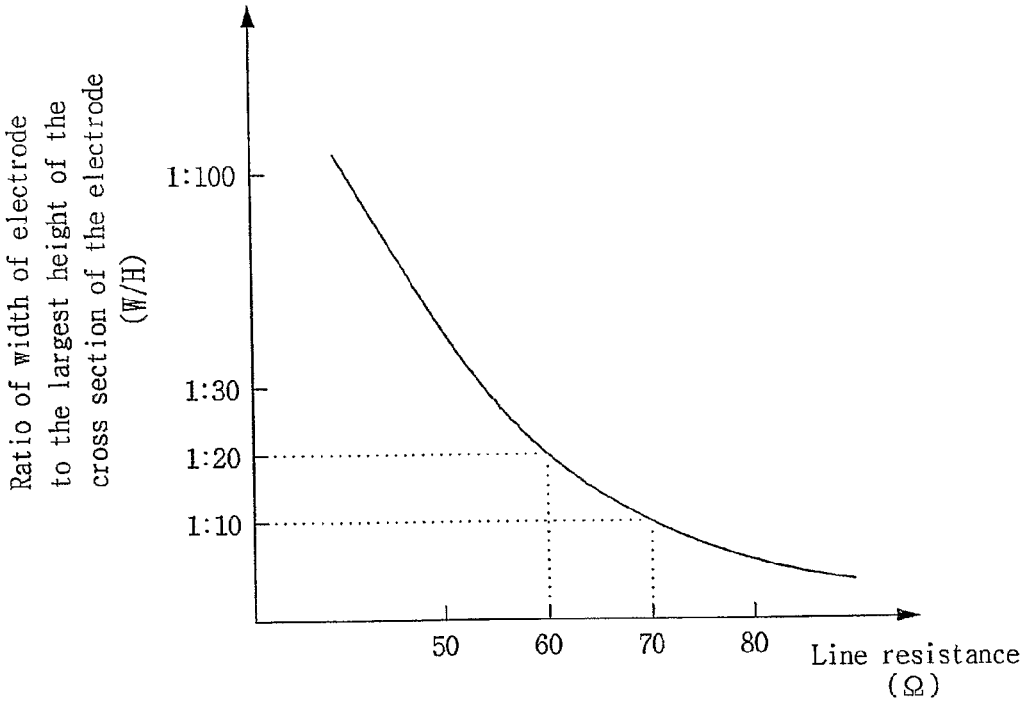

[Fig. 5]
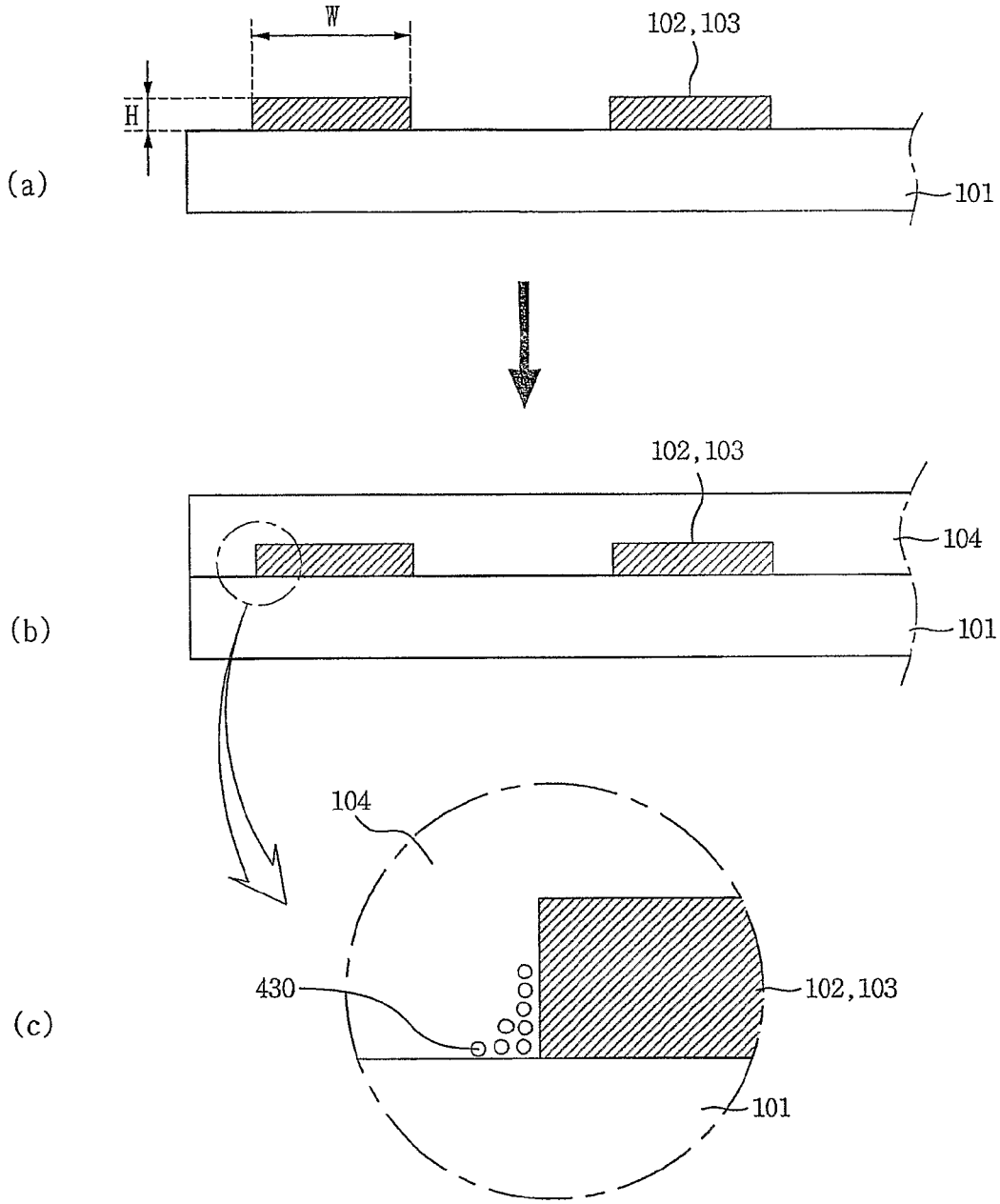

[Fig. 6]
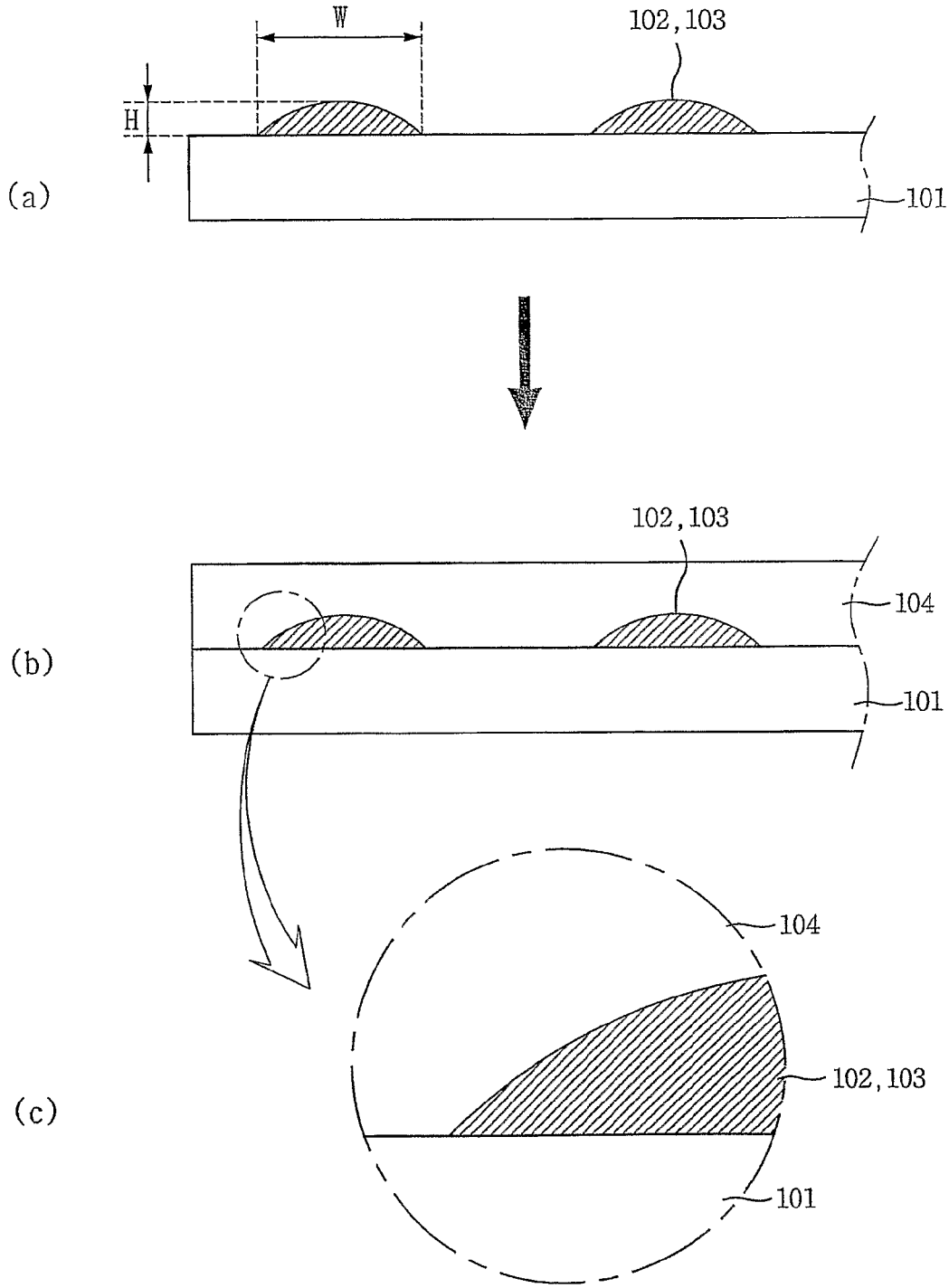

[Fig. 7]
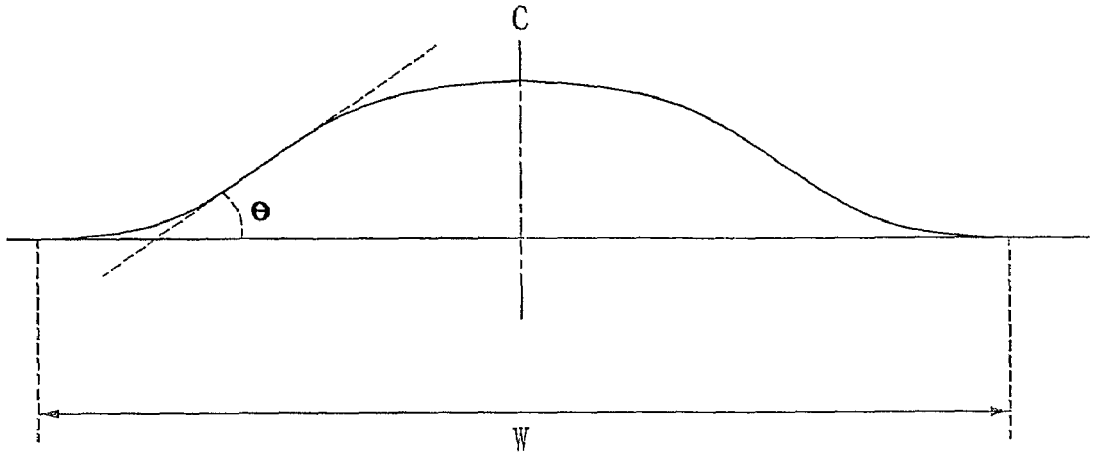

[Fig. 8]
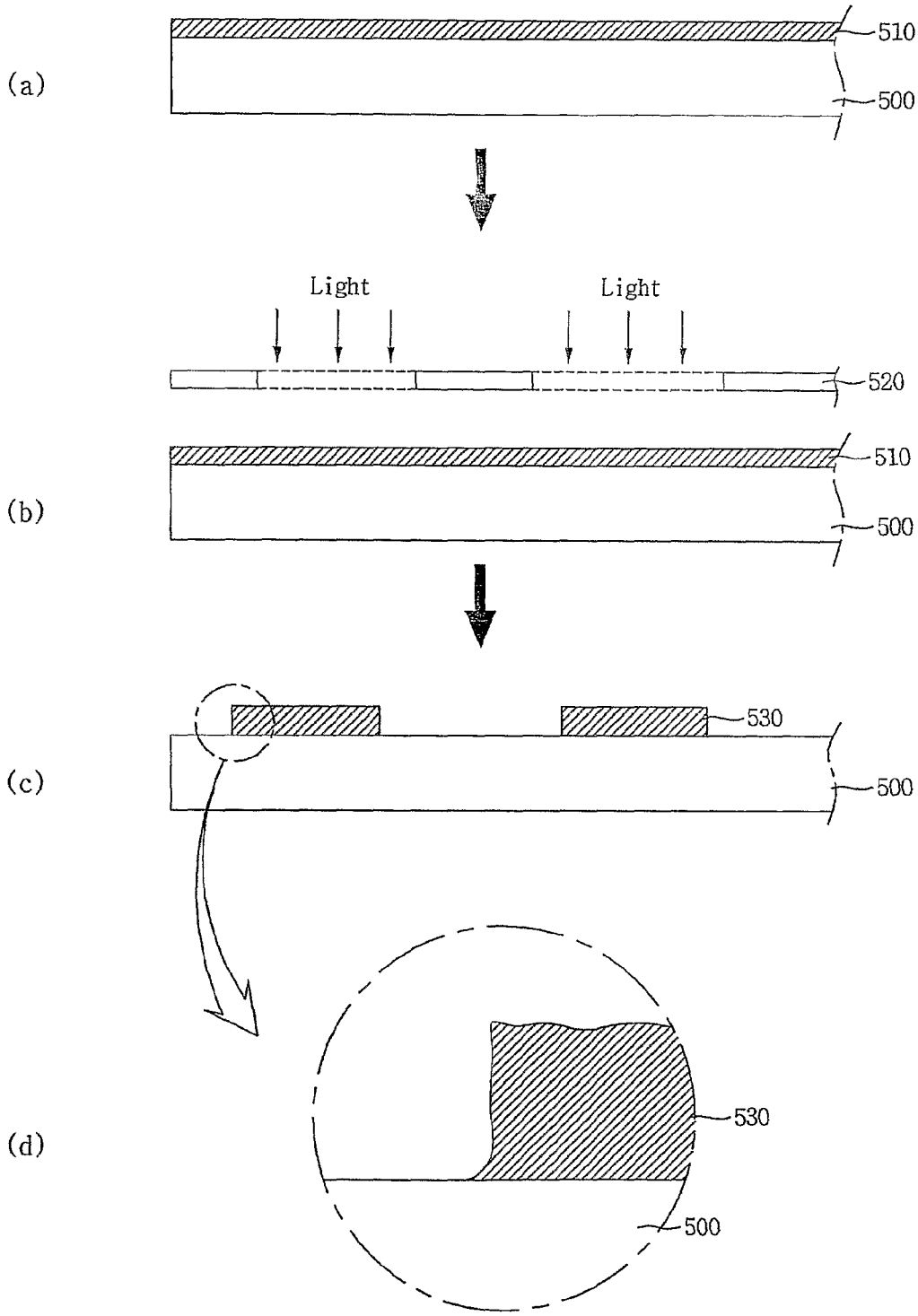

[Fig. 9]
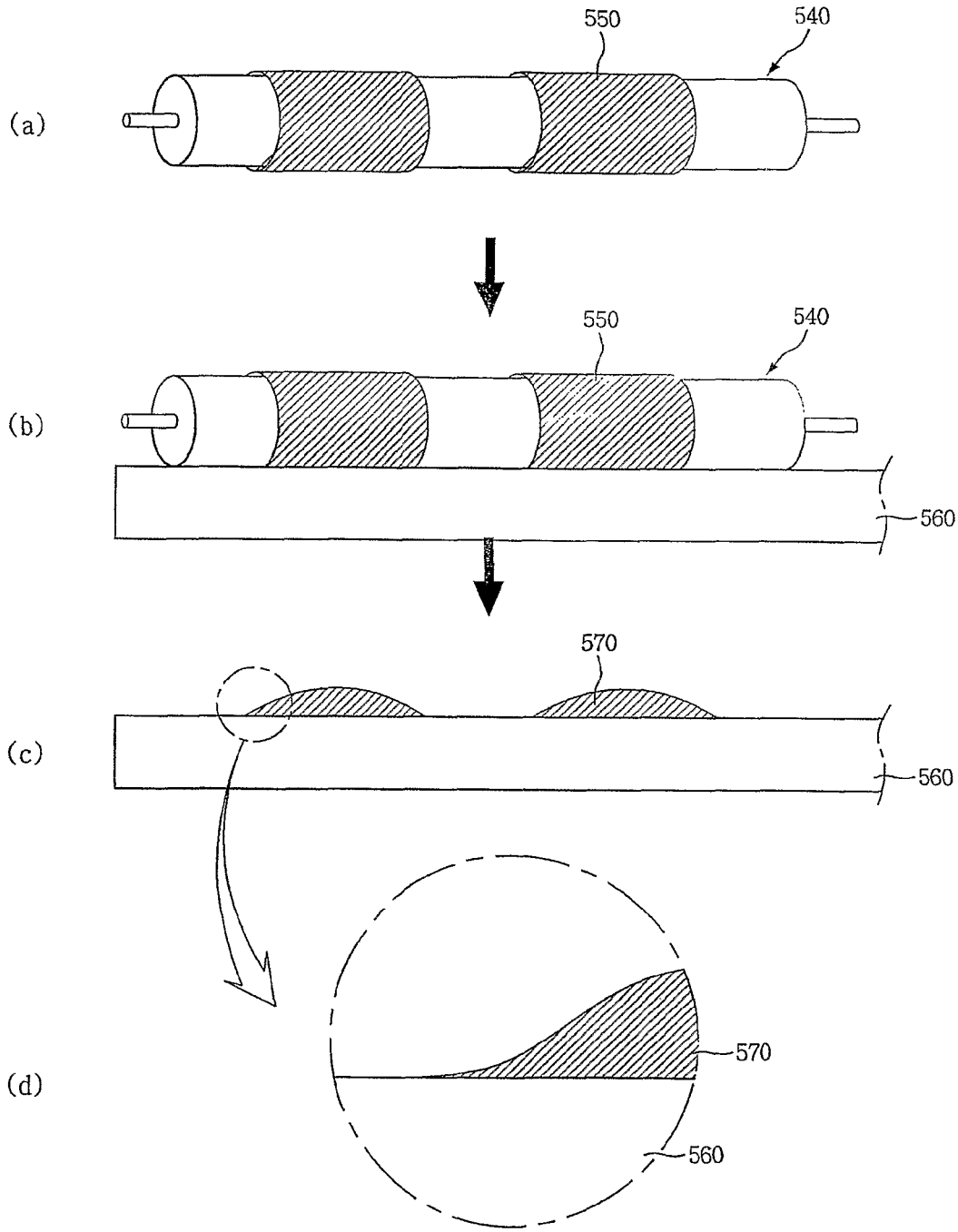

[Fig. 10]
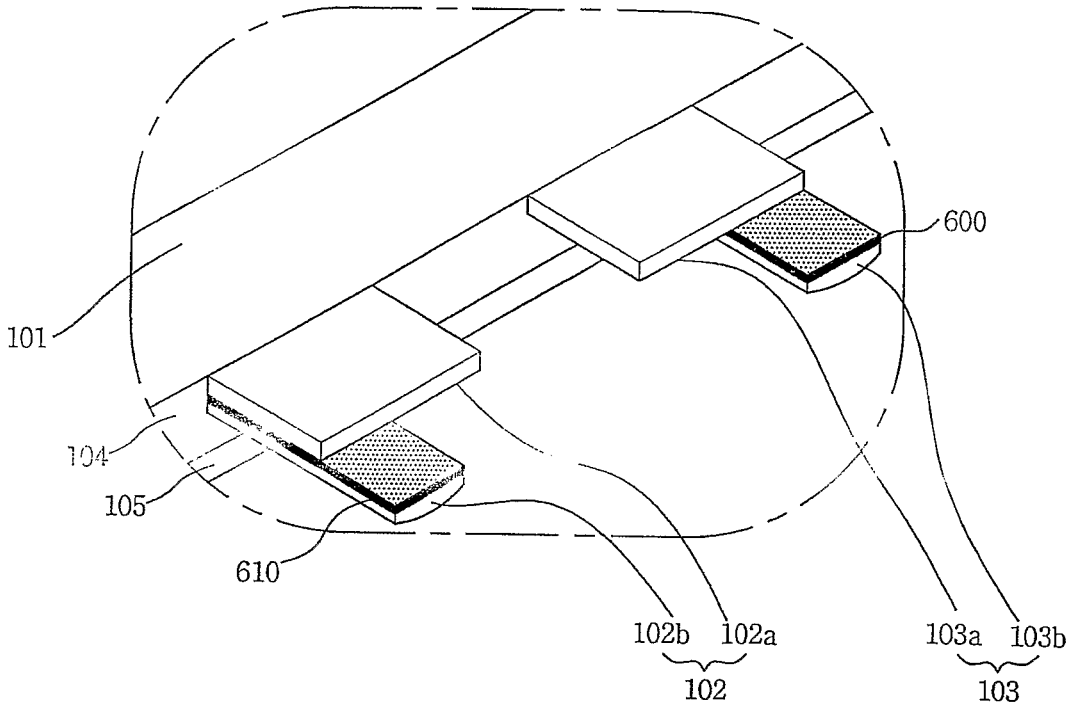

PLASMA DISPLAY PANEL

TECHNICAL FIELD

This document relates to a plasma display panel.

BACKGROUND ART

A plasma display panel generally includes a phosphor layer positioned inside discharge cells partitioned by barrier ribs, and a plurality of electrodes.

Driving signals are supplied to the discharge cells through the plurality of electrodes, thereby generating a discharge inside the discharge cell. During the generation of the discharge, a discharge gas filled in the discharge cell generates vacuum ultraviolet rays, which thereby cause the phosphor layer to emit light, thus generating visible light. An image is displayed on the screen of the plasma display panel through visible light.

DISCLOSURE OF INVENTION

Brief Description of the Drawings

FIG. 1 illustrates a structure of a plasma display panel according to an exemplary embodiment;

FIG. 2 illustrates a structure of an electrode of a plasma display panel according to an exemplary embodiment;

FIG. 3 illustrates another structure of an electrode of a plasma display panel according to an exemplary embodiment;

FIG. 4 is a graph showing a line resistance depending on a structure of an electrode of a plasma display panel according to an exemplary embodiment;

FIG. 5 illustrates a phenomenon generated between a substrate and an electrode depending on a shape of the electrode when the electrode is formed on the substrate;

FIG. 6 illustrates another phenomenon generated between a substrate and an electrode depending on a shape of the electrode when the electrode is formed on the substrate;

FIG. 7 illustrates a cross-sectional shape of an electrode of a plasma display panel according to an exemplary embodiment;

FIG. 8 illustrates a method for forming an electrode of a plasma display panel according to an exemplary embodiment;

FIG. 9 illustrates another method for forming an electrode of a plasma display panel according to an exemplary embodiment; and FIG. 10 illustrates another structure of a plasma display panel according to an exemplary embodiment.

MODE FOR THE INVENTION

FIG. 1 illustrates a structure of a plasma display panel according to an exemplary embodiment.

As illustrated in FIG. 1, the plasma display panel according to an exemplary embodiment includes a front panel 100 and a rear panel 110 which are coalesced to be opposite to each other. The front panel 100 includes a front substrate 101 on which scan electrodes 102 and sustain electrodes 103 are formed in parallel to each other. The rear panel 110 includes a rear substrate 111 on which address electrodes 113 are formed to intersect the scan electrodes 102 and the sustain electrodes 103.

An upper dielectric layer 104 for covering the scan electrode 102 and the sustain electrode 103 may be formed on the front substrate 101 on which the scan electrode 102 and the sustain electrode 103 are formed.

The upper dielectric layer 104 can limit discharge currents of the scan electrode 102 and the sustain electrode 103, and provide electrical insulation between the scan electrode 102 and the sustain electrode 103.

A protective layer 105 is formed on an upper surface of the upper dielectric layer 104 to facilitate discharge conditions. The protective layer 105 may be formed by depositing a material such as magnesium oxide (MgO) on the upper dielectric layer 104.

The address electrode 113 formed on the rear substrate 111 receives a data signal applied to a discharge cell.

A lower dielectric layer 115 for covering the address electrode 113 may be formed on the rear substrate 111 on which the address electrode 113 is formed. The lower dielectric layer 115 can provide electrical insulation between the address electrodes 113.

Barrier ribs 112 of a stripe type, a well type, a delta type, a honeycomb type, and the may be formed on the lower dielectric layer 115 to partition discharge cells. A red (R) discharge cell, a green (G) discharge cell, and a blue (B) discharge cell, and the like, may be formed between the front substrate 101 and the rear substrate 111.

Each of the discharge cells partitioned by the barrier ribs 112 is filled with a predetermined discharge gas.

Red (R), green (G) and blue (B) phosphor layers 114 may be formed inside the discharge cells partitioned by the barrier ribs 112 to emit visible light for an image display during the generation of an address discharge.

The above-described plasma display panel generates a discharge inside the discharge cells partitioned by the barrier ribs 112 when driving signals are applied to the scan electrode 102, the sustain electrode 103, or the address electrode 113.

FIGS. 2 and 3 illustrate various structures of an electrode of a plasma display panel according to an exemplary embodiment.

First, as illustrated in FIG. 2, the electrodes 102 and 103 formed on the substrate 101 each have a larger cross-sectional height H as they go from both ends to a central axis C thereof.

A shape of a cross section of each of the electrodes 102 and 103 is a curved surface in a direction of the central axis C. In this case, the shape of the cross section of each of the electrodes 102 and 103 is the curved surface in a portion where the electrodes 102 and 103 contact the substrate 101. Hence, even if a viscosity of a dielectric material is relatively large, a space between the electrodes 102 and 103 and the substrate 101 can be fully filled with a dielectric material. Accordingly, the generation of foam in the space between the electrodes 102 and 103 and the substrate 101 can be further reduced.

When the shape of the cross section of each of the electrodes 102 and 103 is the curved surface, the structure of the electrodes 102 and 103 is stable. Therefore, the density of the electrodes 102 and 103 and the uniformity of the shape of the electrodes 102 and 103 can be further improved.

As illustrated in FIG. 3, a height H1 of the electrodes 102 and 103 around a central axis C of a cross section of each of the electrodes 102 and 103 formed on the substrate 101 is larger than a height H2 of the electrodes 102 and 103 at an edge of the cross section of each of the electrodes 102 and 103. In other words, the smallest height of the electrodes 102 and 103 around the central axis C is at least larger than a height of the electrodes 102 and 103 at the edge.

Because the space between the electrode having the structure of FIGS. 2 and 3 and the substrate is fully filled with the dielectric material, the generation of foam in the space between the electrode and the substrate is reduced and insulation breakdown of the electrode is prevented.

A width W of the electrode having the structure of FIGS. 2 and 3 may range from 50 μm to 200 μm in consideration of the size of the discharge cells on the substrate. When a height of the cross section of the electrode having the structure of FIGS. 2 and 3 approximately ranges from 1 μm to 20 μm, the uniformity of the dielectric material covering the electrode is satisfactory.

Although FIGS. 2 and 3 have illustrated the scan and sustain electrodes 102 and 103 as an example of the electrode, the electrode structure of FIGS. 2 and 3 may be applied to the address electrode 113 formed on the rear substrate 111.

Further, the electrode having the structure of FIGS. 2 and 3 has to meet at least line resistance conditions capable of increasing the driving efficiency of the plasma display panel during the driving of the plasma display panel FIG. 4 is a graph showing a line resistance depending on a structure of an electrode of a plasma display panel according to an exemplary embodiment.

As illustrated in FIG. 4, as a ratio of the width of the electrode formed on the substrate to the largest height of the cross section of the electrode increases, a line resistance of the electrode decreases.

Accordingly, the line resistance of the electrode decreases by increasing the width of the electrode or reducing the largest height of the cross section of the electrode, and thus the driving efficiency of the plasma display panel is improved. However, as described above, because the size of the discharge cells needs to be considered, the largest height of the cross section of the electrode is controlled in a state in which the width of the electrode is fixed.

When the line resistance of the electrode is less than 70 during the driving of the plasma display panel in consideration of the above conditions, the driving efficiency of the plasma display panel can be secured.

Accordingly, the ratio of the width W of the electrode to the largest height H or H1 of the cross section of the electrode may range from 10:1 to 100:1. Further, the ratio of the width W of the electrode to the largest height H or H1 of the cross section of the electrode may range from 10:1 to 20:1 so as to increase the driving efficiency by controlling the line resistance of the electrode to be less than 60.

FIGS. 5 and 6 illustrate phenomena generated between a substrate and an electrode depending on a shape of an electrode when the electrode is formed on the substrate.

As illustrated in (a) of FIG. 5, the shape of the cross section of the electrodes 102 and 103 is rectangular. As illustrated in (b) of FIG. 5, the dielectric layer 104 is formed to cover the electrodes 102 and 103. In this case, because the dielectric layer 104 is generally formed using various methods, for example, a laminating method, the space between the electrodes 102 and 103 and the substrate 101 is not fully filled with a dielectric material forming the dielectric layer 104.

Therefore, as illustrated in (c) of FIG. 5, a predetermined gas or moisture is collected in the space between the electrodes 102 and 103 and the substrate 101. This leads to the generation of foam 430 in the space. The foam 430 may increase a resistance, thereby reducing the driving efficiency of the plasma display panel. Furthermore, the foam 430 may cause insulation breakdown of the electrodes 102 and 103 during the driving of the plasma display panel.

However, as illustrated in (a) of FIG. 6 having the electrode structure according to an exemplary embodiment, the shape of the cross section of the electrodes 102 and 103 is a curved surface. As illustrated in (b) of FIG. 6, the dielectric layer 104 is formed to cover the electrodes 102 and 103. Hence, as illustrated in (c) of FIG. 6, the space between the electrodes 102 and 103 and the substrate 101 is fully filled with a dielectric material forming the dielectric layer 104 so that foam is not generated in the space. In FIG. 6, the shape of the cross section of the electrodes 102 and 103 is the curved surface around an end of the electrodes 102 and 103.

FIG. 7 illustrates a cross-sectional shape of an electrode of a plasma display panel according to an exemplary embodiment.

As illustrated in FIG. 7, the largest angle formed by the curved surface of the electrodes 102 and 103 and the substrate 101 in the cross section of the electrodes 102 and 103 may range from 1 to 12° When the largest angle is less than 1° the electrodes 102 and 103 are excessively thin, thereby excessively increasing an electrical resistance and reducing the driving efficiency of the plasma display panel. When the largest angle is more than 12° the space between the electrodes 102 and 103 and the substrate 101 is sharply depressed and the space is not fully filled with the dielectric material and thus foam may be generated in the space.

FIGS. 8 and 9 illustrate methods for forming an electrode of a plasma display panel according to an exemplary embodiment.

First, as illustrated in (a) of FIG. 8, an electrode material layer 510 is formed on a substrate 500. More specifically, an electrode material in a paste state or a slurry state obtained by mixing an electrically conductive material such as silver (Ag) with another material such as a solvent and a binder is coated on the substrate 500, thereby forming the electrode material layer 510.

Next, as illustrated in (b) of FIG. 8, a mask 520 having a predetermined pattern is positioned on the substrate 500 on which the electrode material layer 510 is formed. Light such as ultraviolet rays is irradiated on the electrode material layer 510 through the predetermined pattern of the mask 520 to harden a portion of the electrode material layer 510. This may be called an exposure process.

Next, the electrode material layer 510 is etched. This may be called an etching process. Hence, as illustrated in (c) of FIG. 8, an electrode 530 having a predetermined pattern is formed on the substrate 500.

As above, the electrode 530 formed through the exposure and etching processes has a cross section of a shape illustrated in (d) of FIG. 8 because a portion of the electrode material layer 510 is etched using an etchant or a sand In a case where the electrode 530 is formed through the exposure and etching processes as illustrated in FIG. 8, it is difficult to prevent the generation of foam between the substrate 500 and the electrode 530.

On the other hand, when an electrode is formed as illustrated in FIG. 9, it is easy to prevent the generation of foam. More specifically, as illustrated in (a) of FIG. 9, an electrical material 550 is coated on a roller 540. The electrical material 550 may be in a paste state or a slurry state.

Next, as illustrated in (b) of FIG. 9, the roller 540 on which the electrical material 550 is coated is positioned on a substrate 560. As the roller 540 rotates, as illustrated in (c) of FIG. 9, the electrical material 550 coated on the surface of the roller 540 is coated on the substrate 560 to form an electrode 570.

As above, since a portion of the electrode 570 formed through a direct patterning method is not etched by an etchant or a sand and the electrode 570 is formed by directly coating the electrical material 550 on the substrate 560, a cross section of the electrode 570 is shaped like a parabola illustrated in (d) of FIG. 9.

Accordingly, it is easy to prevent the generation of foam between the substrate 560 and the electrode 570.

Although the explanation was given of an example of an off-set method out of the direct patterning method, various methods such as a printing method may be used.

FIG. 10 illustrates another structure of a plasma display panel according to an exemplary embodiment.

Referring to FIG. 10, the scan electrode 102 and the sustain electrode 103 each may include two layers.

For instance, the scan electrode 102 and the sustain electrode 103 each include transparent electrodes 102*a* and 103*a* made of a transparent material such as indium-tin-oxide (ITO) and bus electrodes 102*b* and 103*b* made of a material of high electrical conductivity such as silver (Ag) so as to emit light generated within the discharge cell to the outside and to secure the driving efficiency.

In a case where the scan electrode 102 and the sustain electrode 103 each include the transparent electrodes 102*a* and 103*a* and the bus electrodes 102*b* and 103*b*, black layers 600 and 610 may be formed between the transparent electrodes 102*a* and 103*a* and the bus electrodes 102*b* and 103*b* to prevent the reflection of external light caused by the bus electrodes 102*b* and 103*b*.

Although it is not shown in the drawings, the scan electrode 102 and the sustain electrode 103 each may include only a bus electrode.

Since an exemplary embodiment has described and illustrated only an example of the structure of the plasma display panel, an exemplary embodiment is not limited thereto. For instance, while the above description illustrates a case where the upper dielectric layer 104 and the lower dielectric layer 115 each have a singe-layered structure, at least one of the upper dielectric layer 104 and the lower dielectric layer 115 may have a multi-layered structure.

A black layer (not shown) capable of absorbing external light may be further positioned on the barrier rib 112 to prevent the reflection of the external light caused by the barrier rib 112.

As above, it is capable of various changes and modifications in the structure of the plasma display panel according to an exemplary embodiment.

Further, although the explanation was given of an example of the plasma display panel as an image display panel in an exemplary embodiment, an exemplary embodiment may be applied to various image display panels such as a liquid crystal display panel, a field emission display panel, and an organic light emitting display panel.

The invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. A plasma display panel, comprising:

a substrate;

a plurality of address electrodes positioned on the substrate, an entire portion of one of the address electrodes being disposed directly over a surface of the substrate, wherein a height of the address electrode at a center of a cross section of the address electrode is greater than a height of the address electrode at an outer edge of the cross section of the address electrode; and a dielectric layer covering the plurality of the address electrodes, wherein an angle between a tangent to a surface of the cross section of the address electrode and a tangent to the surface of the substrate at a first portion of the cross section of the address electrode is a first angle, an angle between a tangent to the surface of the cross section of the address electrode and a tangent to the surface of the substrate at a second portion of the cross section of the address electrode is a second angle, and an angle between a tangent to the surface of the cross section of the address electrode and a tangent to the surface of the substrate at a third portion of the cross section of the address electrode is a third angle, wherein the second portion is located between the center of the cross section of the address electrode and the third portion, the third portion is located between the first portion and the second portion, and the first angle is smaller than the third angle and wherein the first and third angles are between 0 and 90 degrees, and wherein a shape of the cross section of the address electrode is a Gaussian shape.

2. The plasma display panel of claim 1, wherein both of the first angle and the third angle are greater than the second angle.

3. The plasma display panel of claim 1, wherein a ratio of a width of the address electrode to a maximum height of the cross section ranges from 10 to 100.

4. The plasma display panel of claim 1, wherein a ratio of a width of the address electrode to a maximum height of the cross section ranges from 10 to 20.

5. The plasma display panel of claim 1, wherein the address electrode includes a curved surface disposed opposite to the surface of the substrate.

6. The plasma display panel of claim 1, wherein a width of the address electrode approximately ranges from 50 μm to 200 μm.

7. The plasma display panel of claim 1, wherein a height of the cross section approximately ranges from 1 μm to 20 μm.

8. The plasma display panel of claim 1, wherein the first electrode has a single-layered structure.

9. The plasma display panel of claim 5, wherein a maximum angle between a tangent to the curved surface and the surface of the substrate ranges from 1° to 12°.

10. A plasma display panel, comprising:

a substrate;

a plurality of address electrodes positioned on the substrate, an entire portion of one of the address electrodes being disposed directly over a surface of the substrate, wherein a height of the address electrode at a center of a cross section of the address electrode is greater than a height of the address electrode at an outer edge of the cross section of the address electrode; and a dielectric layer covering the plurality of the address electrodes, wherein an angle between a tangent to a surface of the cross section of the address electrode and a tangent to the surface of the substrate gradually increases from an outer edge of the cross section of the address electrode to a first portion of the cross section of the address electrode, and the angle between the tangent to a curved surface of the cross section of the address electrode and the tangent to the surface of the substrate gradually decreases from the first portion to the center of the cross section of the address electrode and the angle has values which fall between 0 and 90 degrees, and wherein a shape of the cross section of the address electrode is a Gaussian shape.

* * * * *